US007350529B2

(12) United States Patent
Sarvis

(10) Patent No.: US 7,350,529 B2
(45) Date of Patent: Apr. 1, 2008

(54) POUCH CLEANER

(76) Inventor: Edward J. Sarvis, 389 Halberta Cir., Calimesa, CA (US) 92320

( * ) Notice: Subject to any disclaimer, the term of this patent is extended or adjusted under 35 U.S.C. 154(b) by 104 days.

(21) Appl. No.: 10/907,980

(22) Filed: Apr. 22, 2005

(65) Prior Publication Data

US 2006/0237039 A1 Oct. 26, 2006

(51) Int. Cl.
*B08B 3/02* (2006.01)
*B08B 9/00* (2006.01)
*A61F 5/44* (2006.01)

(52) U.S. Cl. ..... 134/166 R; 134/167 R; 134/104.2; 134/96.1; 604/334; 604/335

(58) Field of Classification Search ..... 134/166 R, 134/167 R, 104.2, 96.1; 604/333, 334, 335, 604/3

See application file for complete search history.

(56) References Cited

U.S. PATENT DOCUMENTS 4,194,506 A 3/1980 Voorhies et al.
4,941,878 A 7/1990 Petrik et al.
5,503,633 A * 4/1996 Saunders et al. ..... 604/332
5,709,236 A 1/1998 Rodriguez et al.
5,738,668 A 4/1998 Bugajski et al.
6,224,581 B1 * 5/2001 Withers et al. ..... 604/334
6,532,971 B2 * 3/2003 Deecki ..... 134/22.18

* cited by examiner

*Primary Examiner*—Michael Barr
*Assistant Examiner*—Saeed Chaudhry
(74) *Attorney, Agent, or Firm*—Michael L. Greenberg, Esq.; Greenberg & Lieberman, LLC

(57) ABSTRACT

A device for cleaning an ostomy pouch is provided. The device comprises a waste collector having a wide mouth and a circular aperture in its base, a waste tube, a pedestal and, first and second water sprayers connected to a high pressure water source. An ostomy pouch is hung from the mouth of the waste collector so that its contents are drained out into the waste collector from its closable drain end, while the other distant end of the pouch is attached to a user's stoma. One end of the waste tube is coupled to the aperture in the base of the waste collector while the other end is coupled to the pedestal. The pedestal is fitted onto a waste dispenser. The first water sprayer cleans the waste collector by washing away the contents of the waste collector into the waste dispenser, through the waste tube. The second water sprayer being a straight tube with multiple holes drilled on its sides cleans the colostomy pouch by washing away the contents of the pouch into the waste dispenser, through the waste collector and the waste tube, thereby cleaning the pouch.

1 Claim, 3 Drawing Sheets

POUCH CLEANER

FIELD OF THE INVENTION

The present invention relates to cleaning of pouches or bags which become contaminated with human waste. More particularly, the present invention relates to a device and a method for cleaning colostomy bags and pouches.

BACKGROUND OF THE INVENTION

Some surgical procedures provide substitute paths for elimination of body wastes. This is necessitated by the removal or mal functioning of the gastrointestinal or urinary tract. Examples of such surgeries involving the intestinal tract include colostomy and ileostomy.

The bowel waste and other effluent are diverted through the colon to the surface of the abdomen. An opening or orifice is created in the abdomen for the elimination of the human waste there from. This surgically-created opening or "stoma" is coupled to a flexible waste collecting bag or pouch having an opening communicating therewith. The human waste is collected in the pouch. Periodically, the pouch is detached from the opening in order to eliminate the waste contents. Alternatively, the waste content is eliminated from the pouch using a closable drain end of the pouch, distant from the end connected to the stoma.

Such surgical procedures which result in the creation of an orifice in the body for waste elimination are generally referred to as ostomies and the waste collection pouches are generally called ostomy pouches. Thus, for example, the pouch used by a colostomy patient is typically referred to as a colostomy pouch. The ostomy pouches are generally made of durable high grade rubber or plastic and are, therefore, designed for repeated use. Therefore, the pouches require to be thoroughly cleaned before they can be used again after eliminating the waste contents.

Numerous types of cleaning devices are known in the art for cleaning colostomy pouches and the like. For example, U.S. Pat. No. 5,709,236, issued Jan. 20, 1998 to Rodriguez et al., describes a colostomy pouch rinsing device which utilizes a spray head attached to a tube. Water is supplied to the tube through a rubber hose which is connected to a faucet. A water control handle is provided which allows the user to control the flow of water to the spray head. In operation, the spray head is inserted into the colostomy pouch while a user holds the pouch over a toilet. The user manually holding the pouch during the washing procedure is not entirely satisfactory. In addition, it is easy for sprayed water to contact the user during the spraying procedure and the water and waste material exiting through the lower portion of the bag is prone to splashing in the toilet and can, therefore, contact the user. In order to prevent the splashing the user would be required to bend or kneel in front of the toilet, or else straddle the toilet. These are very uncomfortable postures, especially, for users having undergone a surgery. Since, the cleaning process has to be repeated multiple times in a day, such postures can cause great discomfort to the users.

The ostomy pouch flusher described in U.S. Pat. No. 4,941,878, issued Jul. 17, 1990 to Petrik et al., uses a wand or tube which is inserted into a colostomy pouch so that water can be sprayed into the interior portion of the pouch during the cleaning operation. This device suffers from the same disadvantages described above.

U.S. Pat. No. 5,738,668, issued Apr. 14, 1998 to Bugajski et al., also describes a colostomy bag cleaning device which requires manually holding the bag and inserting a spray tube therein. This device, like the devices described above, requires the patient to insert the spray tube into the colostomy pouch while holding the pouch over the toilet. Thus, this device suffers from the same disadvantages noted above.

U.S. Pat. No. 4,194,506, issued Mar. 25, 1980 to Voorhies et al., discloses a kit for an ostomate. The kit includes a colostomy pouch consisting of a flexible, vertically elongated member with a closed top end for attachment to the stoma, with a downwardly open bottom end that can be opened for flushing, together with a directional water flushing appliance. Since the directional water flushing appliance is manually operated, it suffers from the same disadvantages as described above. In addition, this leaning method can be applied only to the special colostomy pouch included in the kit and is not extendable to all colostomy pouches.

U.S. Pat. No. 6,532,971, issued Mar. 18, 2003 to Deecki et al., describes a device for cleaning the interior and exterior of a colostomy pouch. The pouch is required to be placed in a spray shield, which is then inserted in a toilet. The device includes a middle water sprayer for cleaning the interior of the pouch and two lateral water sprayers for cleaning the exterior of the pouch. Generally a colostomy pouch needs to be cleaned at least 4-5 times a day. Therefore, cleaning the pouch both from the interior and the exterior is a time consuming procedure, as this would also require drying the exterior of the pouch, before it can be used again.

In light of the above, despite the attempts made by the prior art devices, there still exists a need for an improved colostomy pouch cleaning device which allows quick yet sanitary cleaning of a colostomy pouch, while causing minimum discomfort to a user. None of the prior art patents, taken alone or in combination, teaches or suggests the presently claimed colostomy pouch cleaning device.

SUMMARY OF THE INVENTION

The present invention provides a device for cleaning an ostomy pouch. The device comprises a waste collector having a wide mouth and a circular aperture in its base, a waste tube, a pedestal and, first and second water sprayers connected to a high pressure water source. An ostomy pouch, such as a colostomy pouch, is hung from the mouth of the waste collector so that its contents are drained out into the waste collector from its closable drain end, while the other distant end of the pouch is attached to a user's stoma. One end of the waste tube is coupled to the aperture in the base of the waste collector while the other end is coupled to the pedestal. The pedestal is fitted onto a waste dispenser. The first water sprayer cleans the waste collector by washing away the contents of the waste collector into the waste dispenser, through the waste tube. The second water sprayer being a straight tube with multiple holes drilled on its sides cleans the colostomy pouch by washing away the contents of the pouch into the waste dispenser, through the waste collector and the waste tube. Therefore, the pouch cleaning device described in the present invention facilitates the cleaning of a colostomy pouch sanitarily, without requiring a user to bend over, kneel down or straddle the waste dispenser.

Accordingly, a first objective of the invention is to provide a device for cleaning colostomy bags and the like which facilitates the cleaning in a posture comfortable to a user.

A second objective of the invention is to provide a device for cleaning a colostomy pouch or the like which allows sanitary cleaning of the pouch without requiring the user to contact the interior of the pouch during the cleaning operation.

A third objective of the invention is to provide a device for cleaning a colostomy pouch or the like with water sprayers emanating water under high pressure while protecting the user from spray and the contents of the pouch during the cleaning procedure.

A fourth objective of the invention is to provide a device for cleaning a colostomy pouch or the like which provides for the safe and effective cleaning of both the interior of the pouch and a user's stoma simultaneously, if the pouch is attached to the stoma with water proof seals.

A fifth objective of the invention is to provide a device for cleaning a colostomy pouch or the like which further provides for the delivery of waste and water from the cleaning procedure directly to a waste dispenser such as a toilet bowl while protecting the user from contact with the waste and the water.

These and other objects of the present invention will become readily apparent upon further review of the following specification and drawings.

BRIEF DESCRIPTION OF THE DRAWINGS

A more complete appreciation of the invention, and many of the attendant advantages hereof, readily will be apparent as same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1A:
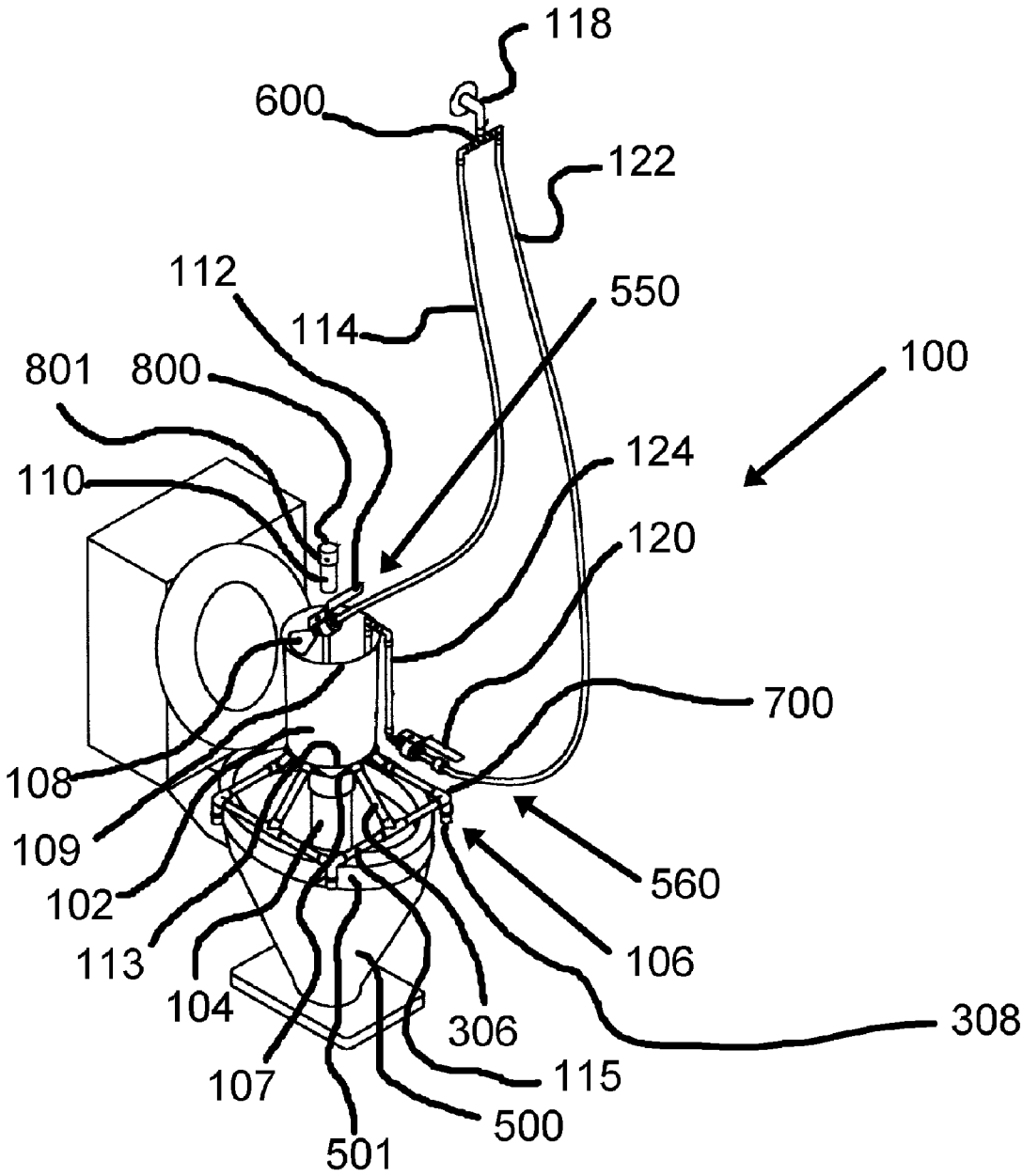
FIG. 1A shows an environmental view of the present invention disposed above a conventional toilet.

FIG. 1A illustrates a pouch cleaning device (100), in accordance with an embodiment of the present invention. The pouch cleaning device (100) is used to hygienically and conveniently dispense the contents of an ostomy pouch or bag, such as a colostomy pouch. A typical colostomy pouch is sealed around a surgically created orifice, called stoma, in a user's abdomen. One end of the colostomy pouch, which is sealed around the stoma, receives the user's body waste, while the other distant end can be opened to drain out the collected waste contents of the pouch. The pouch is cleaned by washing it from the inside after draining away its contents. The cleaning can be performed either after removing the colostomy pouch from the stoma, or while it is still attached to the stoma. In an embodiment of the invention, the pouch cleaning device (100) cleans the colostomy pouch while it is attached to a user's stoma.

The pouch cleaning device (100) comprises a waste collector (102), a waste tube (104), a pedestal (106), a first water sprayer (108) and, a second water sprayer (110). In an embodiment of the invention, the waste collector (102) is a tapering plastic cylindrical container, which has a large circular aperture (109) anterior and a smaller circular aperture (111) in the base (113). The diameter of the large circular aperture (109) of the waste collector (102) is more than the diameter of its base (113). The waste tube (104) is connected to the base (113) of the waste collector (102) by fitting the waste tube's (104) upper tube end (520) into the smaller circular aperture (111) in the base (113). The connection between the waste tube (104) and the waste collector (102) is described in greater detail with reference to FIG. 2.

In an embodiment of the invention, the pedestal (106) is a square frame having a smaller upper end (107) and a larger lower end (115), constructed by using easily available PVC parts. The pedestal (106) is fitted over a waste dispenser (500), such as an American standard toilet bowl. In various embodiments of the present invention, the pedestal (106) can be designed to fit over waste dispensers (500) of various other styles and brands. The lower waste end (510) of the waste tube (104) is coupled to the pedestal (106) by inserting it into the smaller upper end (107) of the pedestal (106). After being coupled with the pedestal (106), the lower waste end (510) of the waste tube (104) remains about 0.75 inches above the water line in the toilet bowl.

The first water sprayer (108) is attached to a first conduit (550) that further comprises a manually operated valve (112) for controlling the flow of water through the first water sprayer (108) and, a flexible hose (114). The hose (114) is connected to a high pressure water source (118). In an embodiment of the invention, the water source is of the kind commonly available in a bathroom. In an embodiment of the invention, the valve (112) is a stainless steel or brass ball valve having an inner diameter of about 0.5 inches and the first water sprayer (108) is a standard spray nozzle. The first water sprayer (108) is used to clean the waste collector (102). The water flowing through the first water sprayer (108) washes away the contents of the waste collector (102) into the waste dispenser (500), through the waste tube (104).

The second water sprayer (110) is attached to a second conduit (560) that further comprises a manually operable valve (120), a flexible hose (122) and a connector (124). The connector (124) connects the valve (120) and the hose (122) to the second water sprayer (110). The hose (122) is connected to the high pressure water source (118). In an embodiment of the invention, a conventional coupler (600) is used to connect the hose (114) and the hose (122) to the water source (118). The connector (124) is designed using multiple tubes and elbow joints in order to place the second water sprayer (110) in an upright position in the waste collector (102). In an embodiment of the invention, the second water sprayer (110) is a straight tube with multiple holes (801) on its sides. The second water sprayer (110) is used to clean a conventional user supplied colostomy pouch, after the contents of the pouch are drained into the waste collector (102), and washed away by the first water sprayer (108). The water flowing through the second water sprayer (110) washes away the contents of the colostomy pouch into the waste collector (102), from where the washed contents are dispensed into the waste dispenser (500) through the waste tube (104).

Figure 1B:
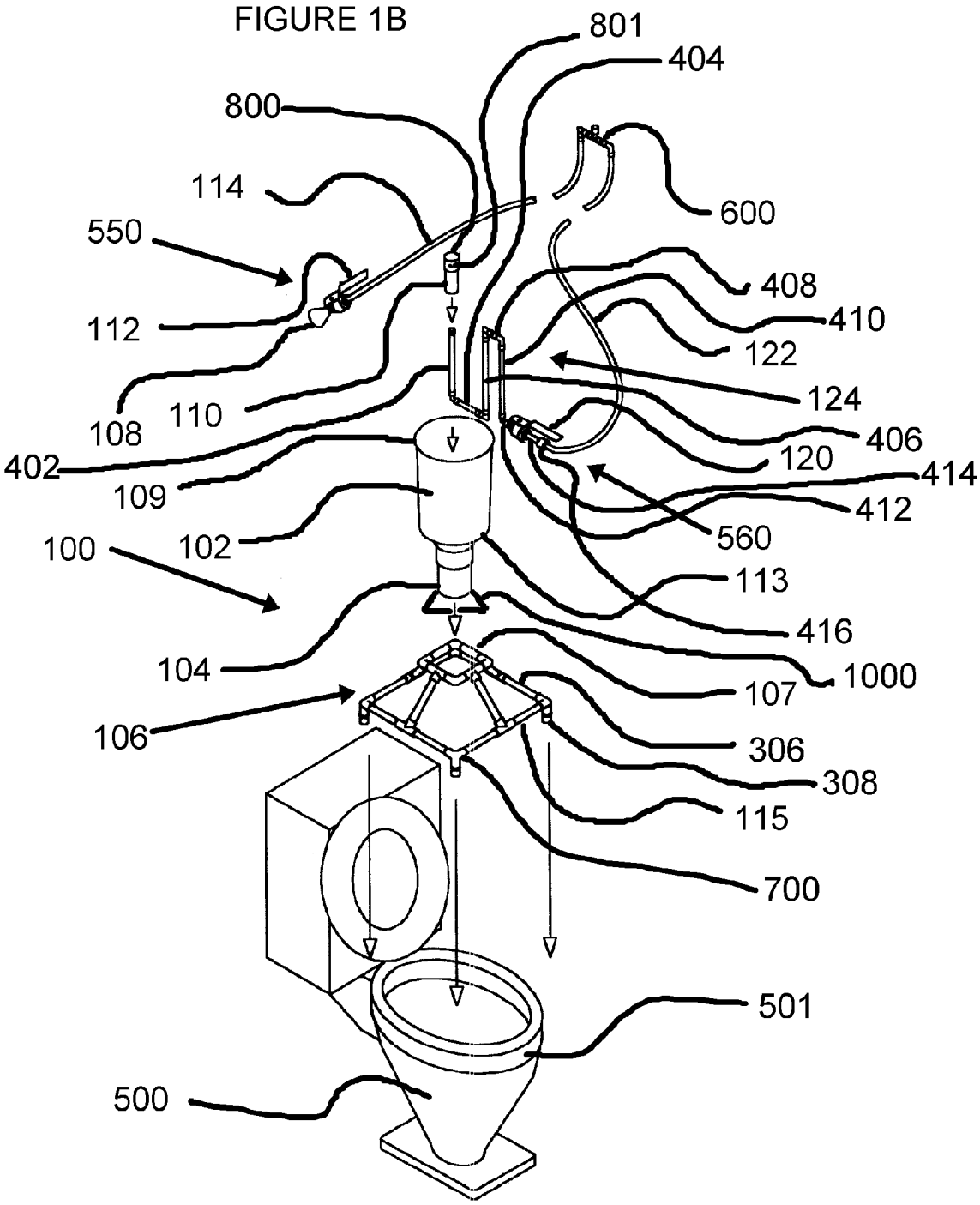
FIG. 1B shows an exploded environmental view of the present invention disposed above a conventional toilet.

FIG. 1B illustrates the assembly of the various parts of the pouch cleaning device (100), in accordance with an embodiment of the invention. In addition, the arrows in FIG. 1B illustrate the direction in which the pedestal (106) is fitted onto the waste dispenser (500). In an embodiment of the invention, the waste collector (102), the waste tube (104), the pedestal (106) and the flexible hose (114) and (122) are made from a plastic material such as PVC, polyethylene, polypropylene, or such similar material.

Figure 2:
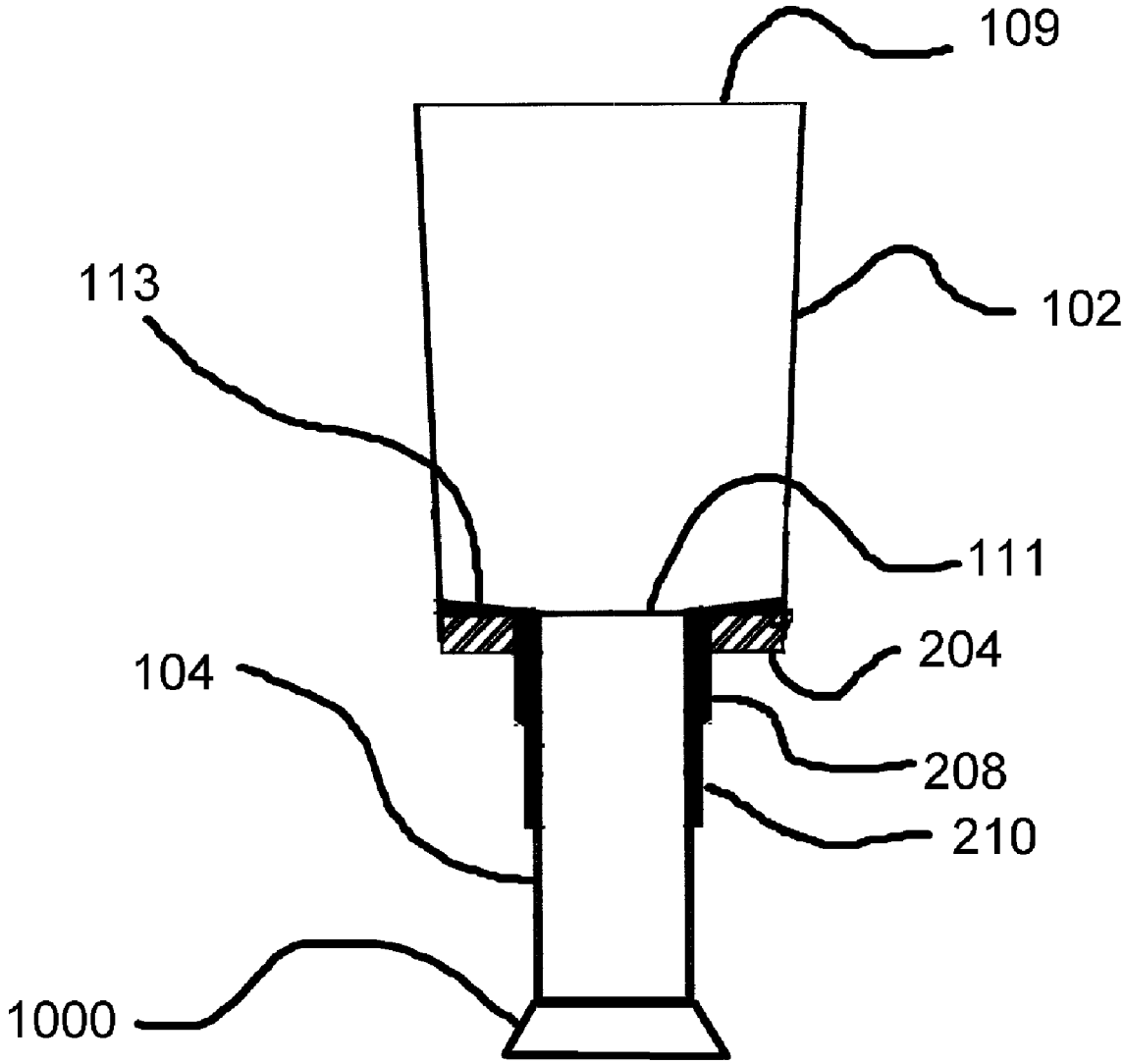
FIG. 2 is a cross sectional view of the waste tube of the present invention.

FIG. 2 is a cross sectional view of the waste tube (104) connected to smaller circular aperture (111) in the base (113) of the waste collector (102), in accordance with an embodiment of the invention. The diameter of large circular aperture (109) of the waste collector (102) is, for example, 8 inches while that of the smaller circular aperture (111) is about 2.75 inches and the depth of the waste collector (102) is about 10.5 inches. The waste tube (104) is a uniform cylindrical pipe with a diameter of about 3.25 inches. The upper end of waste tube (104) is connected to the base (113) of the waste collector (102) by gluing it securely around the smaller circular aperture (111). Therefore, the waste tube (104) is connected to the waste collector (102) in a manner facilitating any waste material collected therein to be drained out through the waste tube (104).

In an embodiment of the invention, a layer of a water resistant plastic material such as Plexiglas (204) is secured to the base (113) of the waste collector (102) around the outer rim of the waste tube (104). In an embodiment, the layer of Plexiglas (204) is a ring having a diameter of about 7 inches and a depth of about 0.75 inches.

The waste collector (102) and waste tube (104) is fitted onto the pedestal (106), by fastening the Plexiglas (204) onto the smaller upper end (107) of the pedestal (106), using conventional screws. For example, the conventional screws are of an easily available variety such as round headed brass wood screws. In an embodiment of the invention, a tube holder (208) is used to hold the waste tube (104) and is also glued to the base of the waste collector (102). In addition, space filler rings (210) are used to fill any gap between the tube holder (208) and the waste tube (104). All the parts illustrated in FIG. 2 are secured together and sealed with an appropriate bonding cement to ensure a tight and water resistant fit.

The pedestal (106) comprises a larger lower end (115) connected to smaller upper end (107) by angled legs (306) as illustrated in FIGS. 1A and 1B. The lower frame (302) is constructed using easily available standard hardware material, such as straight pipes and three-way elbow joints. The smaller upper end (107) is constructed using straight pipes and standard elbow joints. The angled legs (306) are attached to the larger lower end (115) and the smaller upper end (107) using T-joints and are positioned mid way between larger lower end (115) and smaller upper end (107). In an embodiment of the invention, the larger lower end (115) is a square of about 13 inches while the smaller upper end (107) is a square of about 4 inches, and the angled legs (306) are rise up from larger lower end (115) at an angle of about 540.

As shown in FIGS. 1A AND 1B, the pedestal (106) is fitted onto a waste dispenser (500) such as an American standard toilet bowl by securing larger lower end (115) firmly on top of the waste dispenser (500). This is achieved by using a conventional pipe thread such as 0.5 inches male NPT PVC pipe adapters and flat assembly (308). The conventional pipe threads and flats (308) are conventionally attached to the underside of larger lower end (115) by using the three-way elbow joints (700). The pipe threads and flats (308) are adjusted so that the flats hold tightly below the rim (501) of waste dispenser (500).

Returning to FIGS. 1A and 1B, the second water sprayer (110) and the valve (120) coupled together by the connector (124) are illustrated. In an embodiment of the invention, the second water sprayer (110) is a 0.5 inch long copper tubing end cap (800) with 6 holes (801) drilled along its sides. The holes (801) have a diameter of about 0.125 inches. The connector (124) is constructed by joining multiple conventional straight tubes by elbow joints. For example, as shown best in FIG. 1B, in an embodiment of the invention, the connector (124) comprises a copper tubing (402), a copper tubing (404), a copper tubing (406), a copper tubing (408), a copper tubing (410) and, a copper tubing (412), coupled using multiple copper tubing elbow joints. A first end of a 9 inches long copper tubing (402) is connected to a first end of a 1.25 inch long copper tubing (404) by a copper tubing elbow joint. The second end of the 1.25 inches long copper tubing (404) is connected to a first end of a 9.5 inch long copper tubing (406) by another copper tubing elbow joint. The second end of the 9.5 inches long copper tubing (406) is connected to a first end of a 3.5 inch long copper tubing (408) by yet another copper tubing elbow joint. The second end of the 3.5 inches long copper tubing (408) is connected to a first end of an 8 inch long copper tubing (410) by another copper tubing elbow joint. The second end of the 8 inches long copper tubing (410) is connected to the second water sprayer (110). A second end of the 9 inches long copper tubing (402) is connected to a first end a 3 inch long copper tubing (412) by a copper tubing elbow joint.

The second end of the 3 inches long copper tubing (412) is coupled to manually operable valve (120). In an embodiment of the invention, the valve (120) is a stainless steel or brass ball valve having a diameter of about 0.5 inches. The valve (120) is coupled to a 1.5 inch long copper tubing (414). The copper tubing (414) is coupled with a tubing adapter (416) such as a 0.5 inches mal NPT-female tubing adapter in order to couple the connector (124) with the hose (122). The design of the connector (124) is such that when it is placed in the waste collector (102), as illustrated in FIG. 1B, the second water sprayer (110) remains in an upright position. Water under high pressure flows from the water source (118) into the hose (122) and emanates from the holes (801) drilled in the second water sprayer (110), via the tubing adapter (416), copper tubing (414), and the connector (124). In an embodiment of the invention, all the copper tubing and elbow joints have an inner diameter of about 0.5 inches. The outer surfaces of the present invention are preferably covered with a corrosion preventing plating such as chrome plating in order to make them corrosion resistant. The present invention has parts that are fitted tightly together, and the joints between such parts are soldered as per the local plumbing codes. All resulting burrs and sharp edges are removed after soldering.

In various embodiments of the invention, the connector (124) can be of a different design and can be constructed using tubes and connectors of any variety or materials which will hold the second water sprayer (110) in an erect position in the waste collector (102).

The dimensions of the various parts of the pouch cleaning device (100) are stated in order to maximize the performance of the device with currently available colostomy pouches. However, as will be apparent to a person skilled in the art, the dimensions can be modified to adapt a user's requirements, without affecting or changing the functionality of the pouch cleaning device (100).

The pouch cleaning device (100) described herein is conveniently used to clean human waste from a bag or pouch designed to collect human waste through a surgically created opening in a human body. In operation one end of the pouch is hung into the waste collector (102), while the other end is attached to a user's body. Next the un-attached end of the pouch is opened and its contents are drained into the waste collector (102). The valve (112) is opened in order to allow water under high pressure to flow from the water source (118) via the hose (114) and the first water sprayer (108) into the waste collector (102). The water flowing from the first water sprayer (108) washes away the waste contents of the waste collector (102) into a waste dispenser (500) such as an American standard toilet bowl, via the waste tube (104). In another embodiment of the invention, the valve (112) is opened before the contents of the pouch are drained into the waste collector. This ensures that the running water washes away the contents into the waste dispenser as soon as the contents are drained in the waste collector (102). In addition, the continuously running water from the first water sprayer (108) prevents any debris of the waste content from being stuck to the walls of the waste tube (104).

Next, the valve (120) is opened in order to allow water under high pressure to flow from the water source (118) via the hose (122), the connector (124) and the second water sprayer (110) into the waste collector (102). The second water sprayer (110) is inserted into the pouch through the un-attached opening. The water flowing from the second water sprayer (110) washes the interior of the pouch. The waste content remaining in the pouch is washed away into the waste dispenser (500), via the waste collector (102) and the waste tube (104). Because the unattached opening of the pouch is much larger than the diameter of the second water sprayer (110), the water and the washed debris of the waste content easily flow past the waste collector (102) and the waste tube (104) into the waste dispenser.

The cleaning procedure takes only a few minutes and is performed in a hygienic and sanitary manner. Once the pouch has been adequately cleaned, the flow of water from the first and the second water sprayers (108) and (110) may be stopped by closing the valves (112) and (120) respectively. The waste removed from the pouch is conveniently disposed by flushing the waste dispenser (500). If the seals attaching the colostomy pouch to the user's stoma are waterproof, the second water sprayer (110) can be used to wash the stoma also, while washing the interior of the colostomy pouch. If, on the other hand the seals are not water proof the second water sprayer (110) is inserted into the pouch far enough to clean the portion of the pouch below the seals. In an embodiment of the invention, a conventional piece of flexible plastic strip, about 2 inches wide, is pressed against the stoma to prevent water from reaching the seals.

Therefore, the pouch cleaning device described in the present invention facilitates the cleaning of a colostomy pouch without requiring a user to bend over, kneel down or straddle a waste dispenser. The pouch can be cleaned while the user remains in a comfortable posture. The height of the pedestal (106), the waste tube (104) and the waste collector (102) can be adjusted via any conventional manner in order to enable a user to use the pouch cleaning device (100) either in standing posture or while sitting on a chair. In addition, the pouch cleaning device (100) facilitates the cleaning of the pouch while preventing the user from coming in contact with any water or waste content splashing off from the pouch or the waste collector (102).

In an alternate embodiment of the invention, the pouch cleaning device (100) can be made portable so that it can be carried in a travel bag, when the user is away from home.

A splash guard (1000), is shown in FIG. 1B and FIG. 2 so that when the waste tube (104) dumps waste into waste dispenser (500), the waste does not splash all over the interior of waste dispenser (500). Splash guard (1000) is attached to waste tube (104) via any conventional means, such as via a conventional collar that would hold splash guard (1000) to the bottom of waste tube (104).

While the present invention has been described in terms of certain preferred embodiments, one skilled in the art will readily appreciate that various modifications, changes, omissions and substitutions may be made without departing from the spirit thereof. It is intended, therefore, that the present invention be any and all embodiments with the scope of the following claims.

What is claimed is:

1. A device for cleaning an ostomy pouch, the device comprising:

a waste collector having a first aperture and a distant second aperture, the second aperture being smaller than the first aperture, the waste collector receiving the contents of the ostomy pouch through the first aperture;

a waste tube coupled to the second aperture of the waste collector, the waste tube passing washed contents of the waste collector and the ostomy pouch therefrom;

a pedestal having a first large end and a second small end, the second small end receiving an end of the waste tube, the first large end fitting onto a waste dispenser;

a first water sprayer for cleaning the waste collector by washing away the contents of the waste collector through the waste tube into the waste dispenser, the first water sprayer being coupled to a first conduit passing water therefrom;

a second water sprayer for cleaning the ostomy pouch by washing away the contents of the ostomy pouch through the waste tube into the waste dispenser, the second water sprayer being connected to a second conduit passing water therefrom, the second water sprayer comprising a plurality of holes on sides of a straight tube;

a coupler connected to the first and the second conduit for connecting the conduits to a source of water so that the water can flow through the conduits into the first and the second water sprayers;

wherein the pedestal comprises a large square frame coupled to a small square frame using a plurality of angled legs, the square frames comprising a plurality of straight pipes, elbow joints and t-joints.

* * * * *